US007853166B2

(12) United States Patent
Yamada et al.

(10) Patent No.: US 7,853,166 B2
(45) Date of Patent: Dec. 14, 2010

(54) IMAGE FORMING APPARATUS WITH OPERATION DISABLING FEATURE

(75) Inventors: Masakatsu Yamada, Moriya (JP); Tatsuyuki Yamamoto, Toride (JP); Takafumi Katayama, Kashiwa (JP); Daigo Nakagawa, Toride (JP); Hirohisa Sawada, Abiko (JP); Fumihiko Nakamura, Tokyo (JP); Kazuyoshi Sasae, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 424 days.

(21) Appl. No.: 11/752,000

(22) Filed: May 22, 2007

(65) Prior Publication Data

US 2007/0297818 A1 Dec. 27, 2007

(30) Foreign Application Priority Data

Jun. 23, 2006 (JP) ..... 2006-174140

(51) Int. Cl.
*G03G 15/00* (2006.01)

(52) U.S. Cl. ..... 399/81

(58) Field of Classification Search ..... 399/9, 399/13, 90, 379, 380, 81
See application file for complete search history.

(56) References Cited

U.S. PATENT DOCUMENTS

| | | | | |
|---|---|---|---|---|
| 7,512,376 | B2 * | 3/2009 | Suzuki | 399/380 |
| 2004/0184823 | A1 * | 9/2004 | Fujii et al. | 399/9 |

FOREIGN PATENT DOCUMENTS

| | | | |
|---|---|---|---|
| JP | 01-150165 | A | 6/1989 |
| JP | 2002-082590 | A | 3/2002 |
| JP | 2006-027876 | A | 2/2006 |
| JP | 2006-033675 | A | 2/2006 |

* cited by examiner

*Primary Examiner*—David M Gray
*Assistant Examiner*—Gregory H Curran
(74) *Attorney, Agent, or Firm*—Canon U.S.A., Inc., IP Division

(57) ABSTRACT

An image-forming apparatus includes a first unit configured to form an image on a recording medium, a second unit configured to open/close relative to the first unit, and an instructing unit configured to perform an instruction for causing the image-forming apparatus to execute a predetermined operation, wherein the image-forming apparatus is disabled from executing the predetermined operation regardless of whether instruction is performed by the instructing unit when the second unit is in an opened state, and wherein the first unit forms an image on a recording medium regardless of whether the second unit is in an opened state.

8 Claims, 8 Drawing Sheets

IMAGE FORMING APPARATUS WITH OPERATION DISABLING FEATURE

BACKGROUND OF THE INVENTION

1. Field of the Invention

The present invention relates to an image-forming apparatus configured to form an image on a sheet.

2. Description of the Related Art

Of existing image-forming apparatuses, there is an image-forming apparatus serving as a device by which reduction of installation space thereof is realized wherein a scanning unit is provided above an image-forming portion so as to be moved rotationally (see Japanese Patent Laid-Open No. 2002-82590). However, an operator may cause an erroneous operation by unintentionally touching an operating unit when moving rotationally a scanning unit.

Also, with Japanese Patent Laid-Open No. 2006-33675, an arrangement has been disclosed wherein an erroneous operation is prevented when opening a platen cover to set an original. An image-forming apparatus disclosed in Japanese Patent Laid-Open No. 2006-33675 includes at the upper portion an image-scanning unit configured to scan an image on an original optically as image data. The image-scanning unit includes a platen cover configured to be opened/closed with a single side as a supporting point when an operator loads an original on an original plate. An operating panel is provided in the vicinity of the platen cover in the front of the main unit.

With the arrangement in Japanese Patent Laid-Open No. 2006-33675, upon a sensor detecting that the operator opens the platen cover to load an original on the original plate or to extract an original from the original plate, the key operations of the operating panel are disabled for predetermined time. Thus, erroneous operations at the time of the operator loading an original on the original plate, and malfunction caused by the erroneous operation, are prevented. With the arrangement in Japanese Patent Laid-Open No. 2006-33675, the operator is not allowed to operate the image-forming apparatus in a state in which the platen cover is opened, and consequently, is not allowed to operate the image-forming apparatus to make it operate. Accordingly, the performance of the image-forming apparatus in a state in which the platen cover is opened deteriorates.

SUMMARY OF THE INVENTION

The present invention provides an image-forming apparatus by which an erroneous operation caused by an operator unintentionally touching an operating unit is prevented, and also the productivity of forming an image is secured.

An image-forming apparatus includes a first unit configured to form an image on a recording medium, a second unit configured to open/close relative to the first unit, and an instructing unit configured to perform an instruction for causing the image-forming apparatus to execute a predetermined operation, wherein the image-forming apparatus is disabled from executing the predetermined operation regardless of whether the instruction is performed by the instructing unit when the second unit is in an opened state, and wherein the first unit forms an image on a recording medium regardless of whether the second unit is in an opened state.

According to the present invention, the image-forming apparatus can be provided wherein an erroneous operation of the operating unit is prevented, and also high productivity of forming an image is obtained.

Further features of the present invention will become apparent from the following description of exemplary embodiments with reference to the attached drawings.

DESCRIPTION OF THE EMBODIMENTS

An embodiment of an image-forming apparatus according to the present invention will be described in detail with reference to the drawings.

An overview of the entire image-forming apparatus (color MFP device) according to the present invention will be described with reference to FIGS. 1 through 5.

Figure 1:
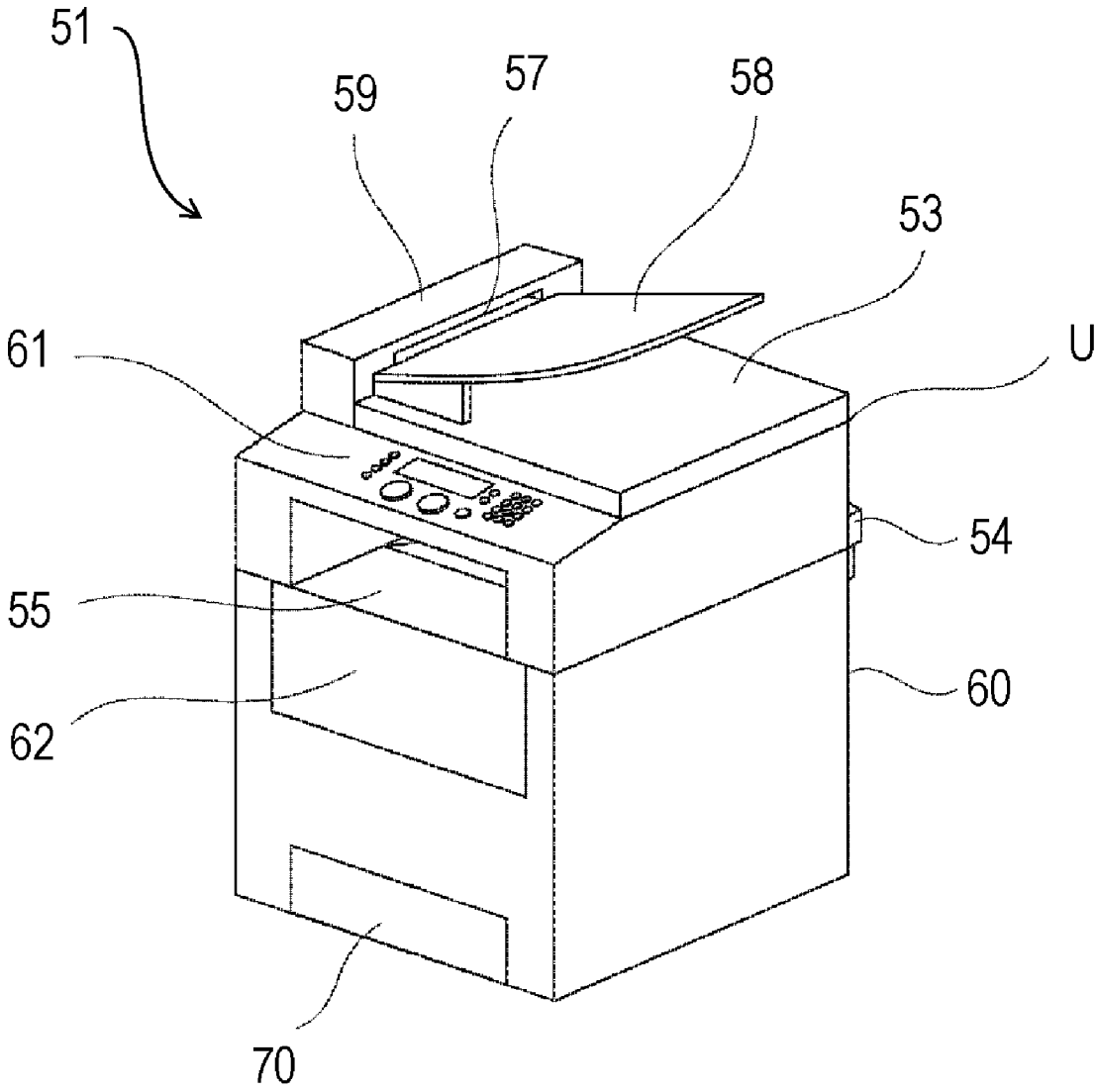
FIG. 1 is an external view of an image-forming apparatus according to an embodiment of the present invention.
Figure 2:
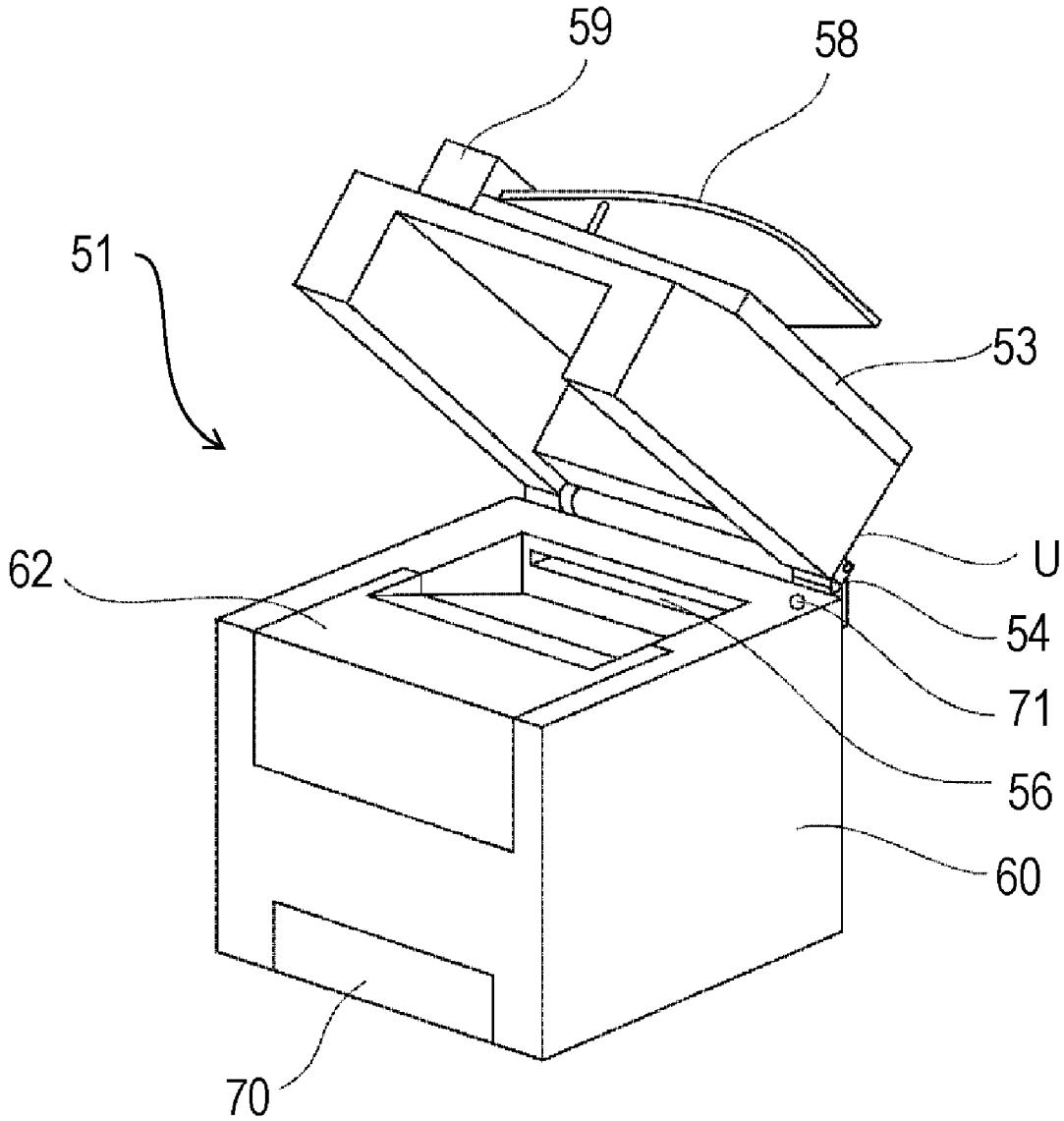
FIG. 2 is an external view when a scanning unit of the image-forming apparatus is opened.

An image-forming apparatus 51 according to the present embodiment has a configuration wherein as shown in FIGS. 1 and 2, a scanning unit U is stacked on the upper portion of an apparatus main unit 60 including an image-forming portion. There is formed an opening portion 55 between the apparatus main unit (first unit) 60 and the scanning unit (a second unit) U, which allows an operator to take out a sheet (recording sheet) discharged from a discharge portion 56 and loaded on the upper surface of the apparatus main unit 60. The scanning unit U in a closed state is provided so as to cover a sheet loaded on the upper surface of the apparatus main unit 60.

The scanning unit U is provided with a mechanism configured to scan an image of an original by the operator setting an original at the upper portion thereof. A platen cover 53 is provided whereby the operator can press an original at the time of scanning an image on a still original. An original-conveyance unit 59 configured to scan a plurality of sheet-shaped originals while conveying these separately one at a time is provided beside the platen cover 53, and an original tray 58 configured to allow the operator to load originals, and also guide an original to an original-insertion portion 57 of an original-conveyance unit 59 is provided on the upper portion of the platen cover 53. The originals loaded on the original tray 58 are separated and conveyed in the inside of the original-conveyance unit 59 from the original-insertion portion 57 one at a time, and are scanned, following which are discharged and loaded between the original tray 58 and the platen cover 53.

Figure 5:
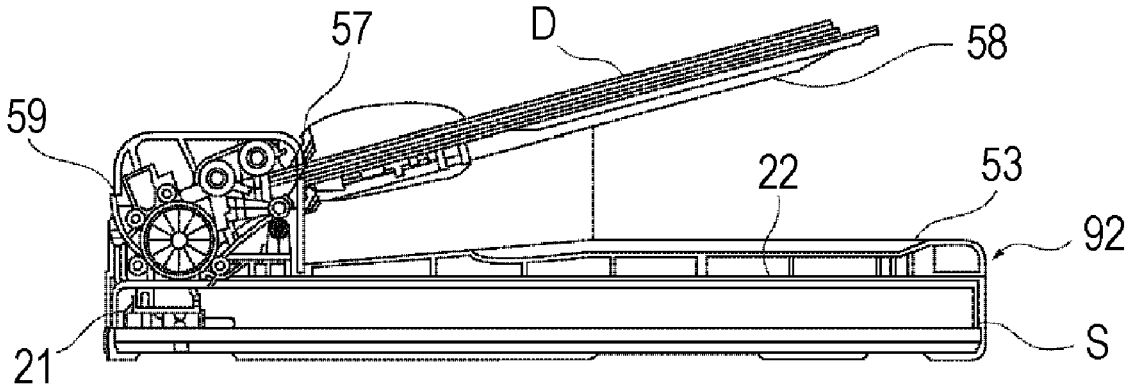
FIG. 5 is a cross-sectional view of a scanning portion.

As shown in the cross-sectional view of the scanning unit U in FIG. 5, the scanning unit U includes the original-conveyance unit 59 configured to convey an original, and a scanner S configured to scan an image on an original. The original-conveyance unit 59 and the scanner S make up a scanning portion 92. The scanner S is provided with a platen glass 22 and a contact-type image sensor 21. The scanner S scans an image on an original conveyed by the original-conveyance unit 59, or an image on an original pressed by the platen cover 53 mounted on the platen glass 22.

With the scanning unit U, in the front of the platen cover 53, and also on the upper portion of the opening portion 55, there is provided an operating unit 61 configured to allow the operator to operate the image-forming apparatus. The operating unit 61 is composed of a display unit configured to display a state of the apparatus, and display various types of settings, and operating keys configured to allow the operator to perform various types of operations and input of settings. Description will be made later in detail regarding the operating unit 61.

Now, there is provided a hinge 54 configured to support the scanning unit so as to move rotationally the scanning unit backward as to the front side of the image-forming apparatus on which the operating unit 61 is provided. The scanning unit U is supported as to the apparatus main unit 60 via the hinge 54, and as shown in FIG. 2, the operator is allowed to lift and move rotationally the scanning unit U backward.

An open/close sensor 71 is provided in the vicinity of the hinge 54. Whether the scanning unit U is lifted and opened, or closed is determined by the open/close sensor 71. Here, as for the open/close sensor configured to detect the opened/closed state of the scanning unit U, a mechanical limit switch or a switch employing an optical photo sensor may be employed. With the present embodiment, in order to detect the opened/closed angle of the scanning unit 52 accurately, a configuration in which an optical transmission-type photo sensor and an actuator are combined is employed.

On the other hand, with the apparatus main unit 60, an image-forming portion employing electrophotography is disposed therein. A maintenance cover 62 is provided on the upper portion in the front of the apparatus main unit 60 so as to allow the operator to open/close the maintenance cover 62 via a hinge 63. As shown in FIG. 2, the operator opens the maintenance cover 62 in a state in which the scanning unit U is opened, whereby the operator can perform the maintenance of the apparatus main unit 60 such as exchange of the cartridge of the image-forming portion, or jam processing at a sheet conveyance path within the apparatus main unit 60. The maintenance cover 62 is provided greatly crossing from the upper surface in the front side to the upper portion of the front surface (whole surface) of the apparatus main unit 60. Accordingly, the operator can readily perform the above-mentioned maintenance work.

Figure 4:
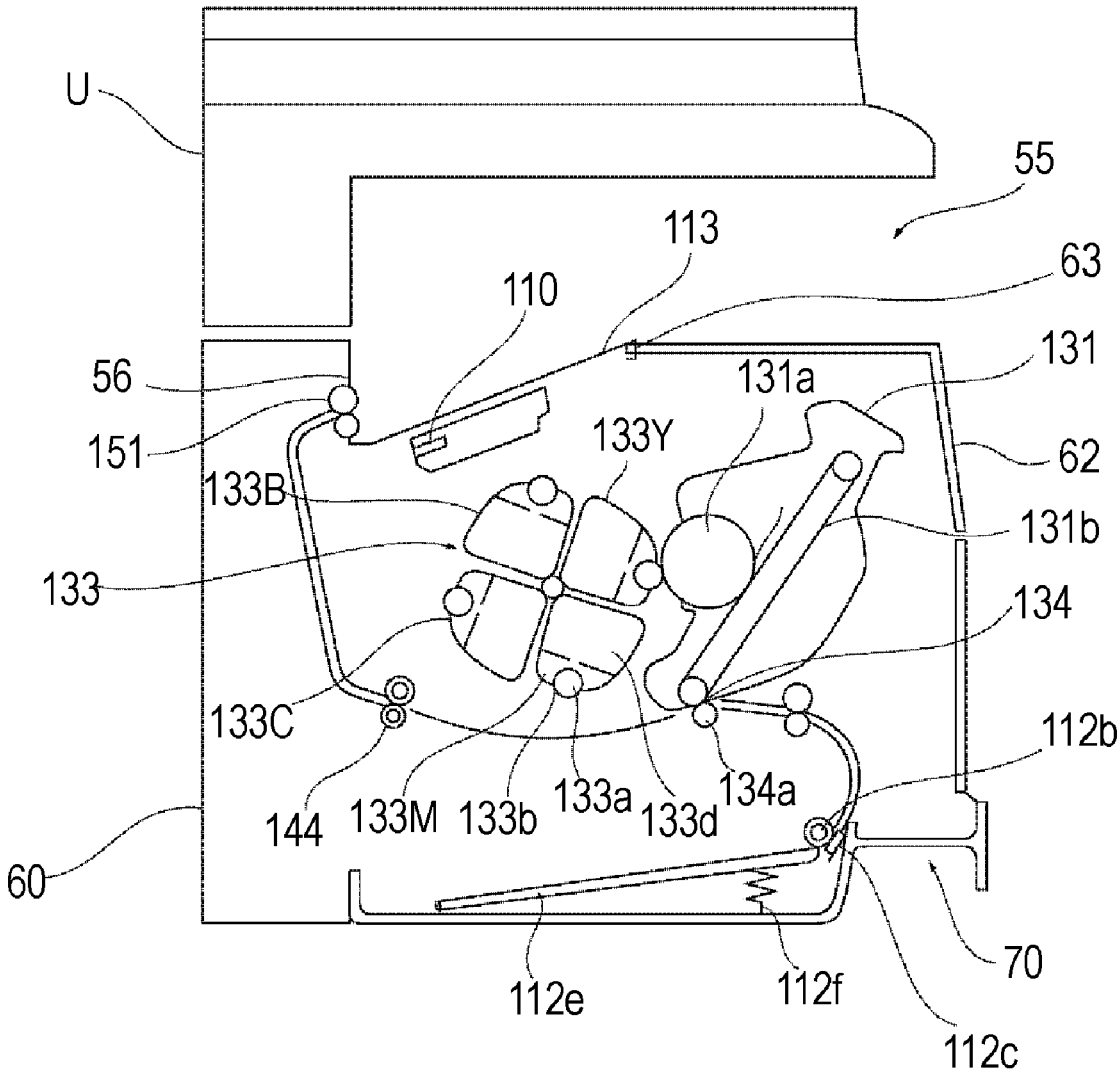
FIG. 4 is a cross-sectional view of an apparatus main unit.

FIG. 4 is a cross-sectional view of the apparatus main unit 60 in which the image-forming portion is provided. Reference numeral 110 denotes a laser scanner, 70 denotes a cassette sheet supply unit, 131 denotes a process cartridge, and 133 denotes development cartridges.

The cassette sheet supply unit 70 is disposed in the bottom of the apparatus main unit 60. The sheets loaded in the cassette sheet supply unit 70 are pressed upward by an sheet plate 112*e* being pressed by an sheet plate spring 112*f*. The sheets pressed upward by the sheet plate spring 112*f* are contacted with a semicircular sheet supply roller 112*b* by pressure, and are conveyed one at a time while being separated by a separation pad 112*c*.

A latent image is formed on an image-bearing member (photosensitive drum) 131*a* serving as a drum-shaped photosensitive member provided in the process cartridge 131 by the laser scanner 110. The latent image is developed by each of the development cartridges moved rotationally to the development position facing the image-bearing member 131*a* by an unshown revolution drum serving as a rotating development cartridge switching mechanism.

The development cartridge 133 main units are composed of a development sleeve 133*a* serving as a development agent bearing member, a development blade 133*b*, a development agent storing portion 133*d*, and so forth. The development sleeve 133*a* is driven by the driving source of the apparatus main unit 60. The unshown revolution drum configured to retain and rotate the development cartridges 133 at both sides in the longitudinal direction of the development cartridges 133 is rotated and driven, whereby the development sleeve 133*a* of each of the development cartridges 133Y, 133M, 133C, and 133B can be stopped at the development position facing the image-bearing member 131*a*.

The development image on the image-bearing member 131*a* is transferred onto an intermediate transfer belt 131*b* by a primary transfer portion 131*c*. The above-mentioned processes of forming a latent image, developing the latent image, and primary transfer are repeated continuously regarding each of the development cartridges 133M, 133C, and 133B, thereby forming a multicolor image on the intermediate transfer belt 131*b*. Subsequently, with a secondary transfer portion 134, the image on the intermediate transfer belt 131*b* is transferred on a sheet supplied from a cassette sheet supply unit 112 by a secondary transfer member 134*a*. Further, the sheet is fixed with a toner image at a fixing unit 144, and is discharged on a sheet discharge portion 113 from the discharge portion 56 by a discharge roller 151.

Now, the image-forming portion provided in the apparatus main unit 60 is composed of the above-mentioned laser scanner 110, cassette sheet supply unit 70, process cartridge 131, development cartridge 13, fixing unit 141, discharge roller 151, and so forth.

The cassette sheet supply unit 70 provided at the lower side in the front of the apparatus main unit 60 is arranged so as to allow the operator to draw out the cassette sheet supply unit 70 in the near-to-operator side (in the front side of the image-forming apparatus) from the apparatus main unit 60 to set sheets.

Figure 6:
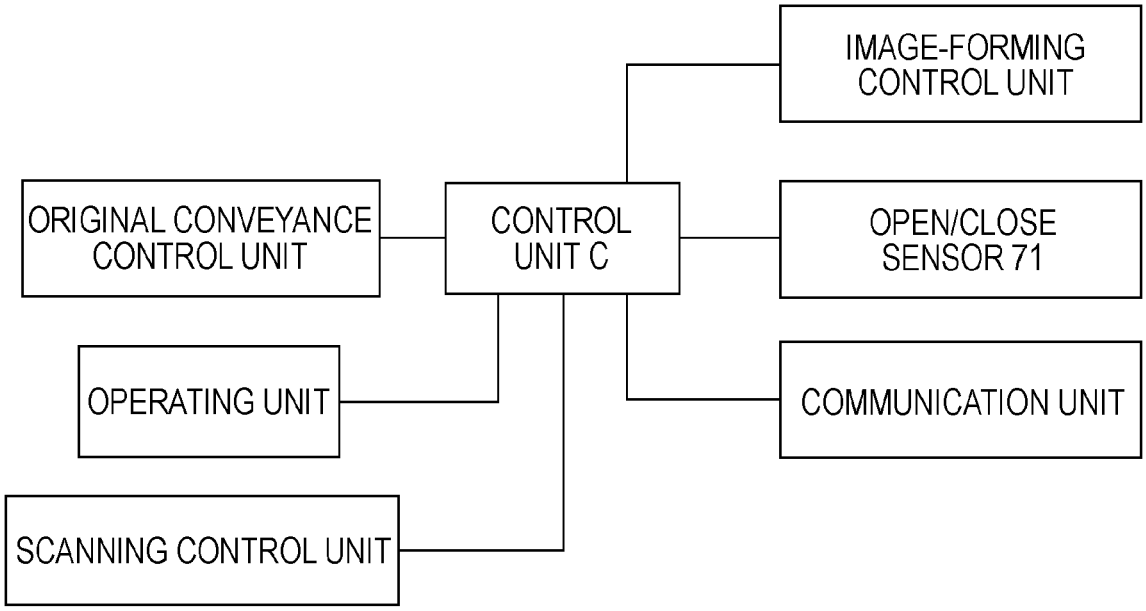
FIG. 6 is a control block diagram of the image-forming apparatus.

The control block diagram of the image-forming apparatus is shown in FIG. 6. A control unit C serving as a controller including CPU, ROM, and RAM is connected with a original-conveyance control unit configured to control the original-conveyance system of the original-conveyance unit 59, a scanning control unit configured to control the scanning operation of the scanner S, and a communication unit configured to perform communication with an external device. Also, the control unit C is connected with an open/close sensor 71, and the operating unit 61. The control unit C executes a program stored in the ROM beforehand to perform control of each unit. The control unit C is a unit configured to control the image-forming apparatus, which controls the original-conveyance unit 59, scanner S, and image-forming portion based on the settings input to the operating unit 61.

Also, the control unit C is connected with an open/close sensor 71. The open/close sensor 71 sends an opened signal to the control unit C when the scanning unit U is in an opened state, and sends a closed signal to the control unit C when the scanning unit U is in a closed state. The control unit C determines whether the scanning unit U is in an opened state or closed state based on those signals from the open/close sensor 71.

Figure 7:
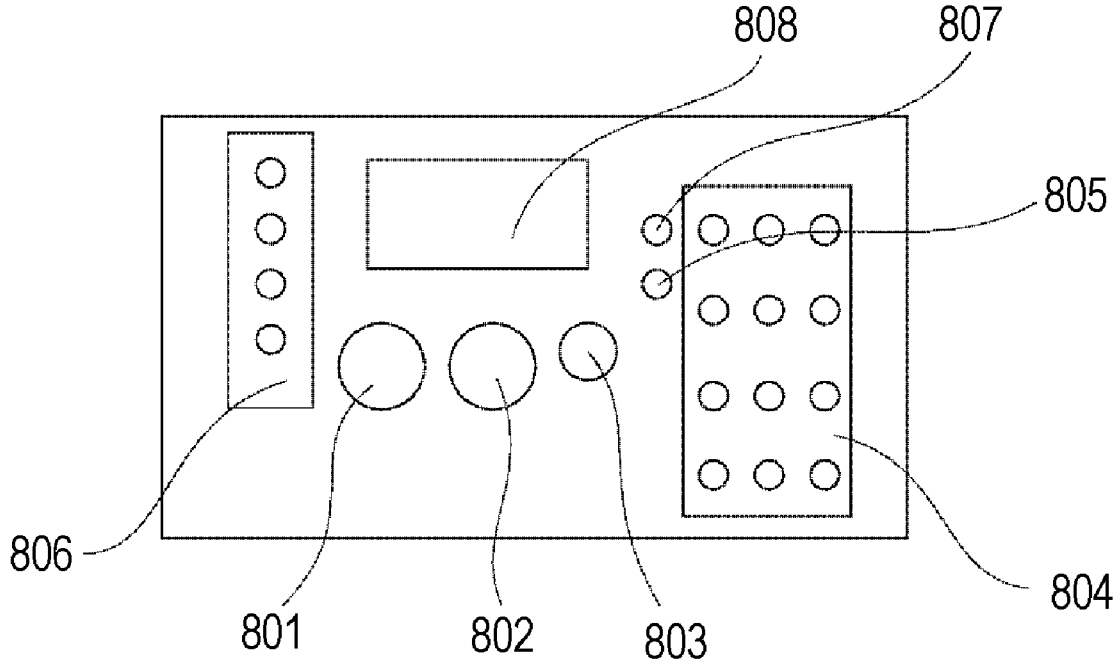
FIG. 7 is a detailed diagram of an operating unit.

In FIG. 7 illustrating the details of the operating unit 61, reference numeral 808 denotes a display unit which is a liquid crystal screen. Reference numeral 804 denotes a numeric keypad configured to allow the operator to input a number. Reference numeral 801 denotes a start key, and 802 denotes a stop key. Reference numeral 805 denotes a power saving key, and 806 denotes a mode switching key. Reference numeral 803 denotes a reset key.

The display unit 808 performs display of the state of the image-forming apparatus, and display of various types of settings. The respective operating keys 801, 802, 803, 804, 805, and 806 are operating keys which the operator operates to perform various types of operations, and input of settings. The operating keys 801, 802, 803, 804, 805, and 806 of the operating unit (instructing unit) 61 are configured to instruct the image-forming apparatus to execute a predetermined operation.

Upon the operator operating each of the operating keys 801, 802, 803, 804, 805, and 806 of the operating unit 61, in response to input thereof the control unit C controls the display unit 806 to change the display thereof. Also, the control unit C controls the original-conveyance unit, scanner S, and image-forming portion via the original-conveyance control unit, scanning-control unit, image-forming control unit based on input of each key, or an instruction from an external device through the communication unit.

For example, in the event of making some copies, the operator selects a copy mode by the mode switching key 806. Subsequently, the operator presses a key or keys of the numeric keypad 804, whereby the number of copies is set. Upon the operator pressing the start key 801, the control unit C controls the original-conveyance unit 59, scanner S, and image-forming portion so as to start copying. Specifically, the control unit C controls the scanner S to scan an image on an original conveyed by the original-conveyance unit 59, or an image on an original mounted on the platen glass. Further, the control unit C controls the image-forming portion to form the image on sheets equivalent to the number of copies set by the operator based on the image scanned by the scanner S.

Also, in the event of sending a fax, the operator selects a fax mode by operating the mode-switching key 806. Subsequently, the operator inputs the number of a fax transmission destination using the numeric keypad 804, whereby the fax transmission destination is set. Upon the operator pressing the start key 801, the control unit C controls the original-conveyance unit 59, scanner S, and so forth to send a fax. Specifically, the control unit C controls the scanner S to scan an image on an original conveyed by the original-conveyance unit 59, or an image on an original mounted on the platen glass. Subsequently, the control unit C performs control so as to send the information of the image scanned by the scanner S to the fax transmission destination set through the communication unit.

Note that upon the operator pressing the stop key 802 on the operating unit 61, the control unit C performs control so as to stop the operation of each unit being operated. Upon the operator pressing the power saving key 805, the control unit C controls the image-forming portion to make the transition to a power saving state. Upon the operator pressing the reset key 803, the control unit C cancels a setting performed by input of each operating key, and returns the setting to an initial state.

Here, with the present embodiment, opening the scanning unit U such as shown in FIG. 2 is indispensable to open the maintenance cover 62. Further, the sheet-discharge portion 113 is exposed by the operator opening the scanning unit U such as shown in FIG. 2, the operator can readily take out sheets loaded in the sheet-discharge portion 113.

The operating unit 61 of the scanning unit U is disposed on the upper portion in the near-to-operator side of the scanning unit U (the front side of the image-forming apparatus) at the center portion in the horizontal direction in light of visibility and operability thereof. This position of the operating unit 61 is also a position where the operator readily touches unintentionally when closing the scanning unit U.

When opening the scanning unit U, the easiest method for the operator is to lift the lower side of the operating unit 61, and the upper surface of the opening portion 55. Thus, the probability that the operator will unintentionally press an operating key of the operating unit 61 is reduced, and also the operator can look at the operating unit 61 when applying his/her hand to that portion of the scanning unit U, and accordingly, the can also avoid pressing an operating key even intentionally. However, when closing the scanning unit U, the operator cannot readily look at the operating unit 61, and also it is the easiest for the operator to hold and depress a certain position of the operating unit 61, which leads the operator to unintentionally press any one of the keys on the operating unit 61 with a higher probability.

At this time, if the operations by the operating keys are enabled, an unintentional operation of the operator such as the scanning portion 52 starting to move, internal settings being changed, or the like, is performed according to the key pressed, which confuses the operator.

Accordingly, in order to solve this problem, with the present embodiment, the open/close sensor 71 detects the opened/closed state of the scanning portion 52, the control unit C performs control so as to disable or enable an operation from the operating unit 61, whereby a command due to an unintentional operation of the operator is prevented from being executed.

Figure 3:
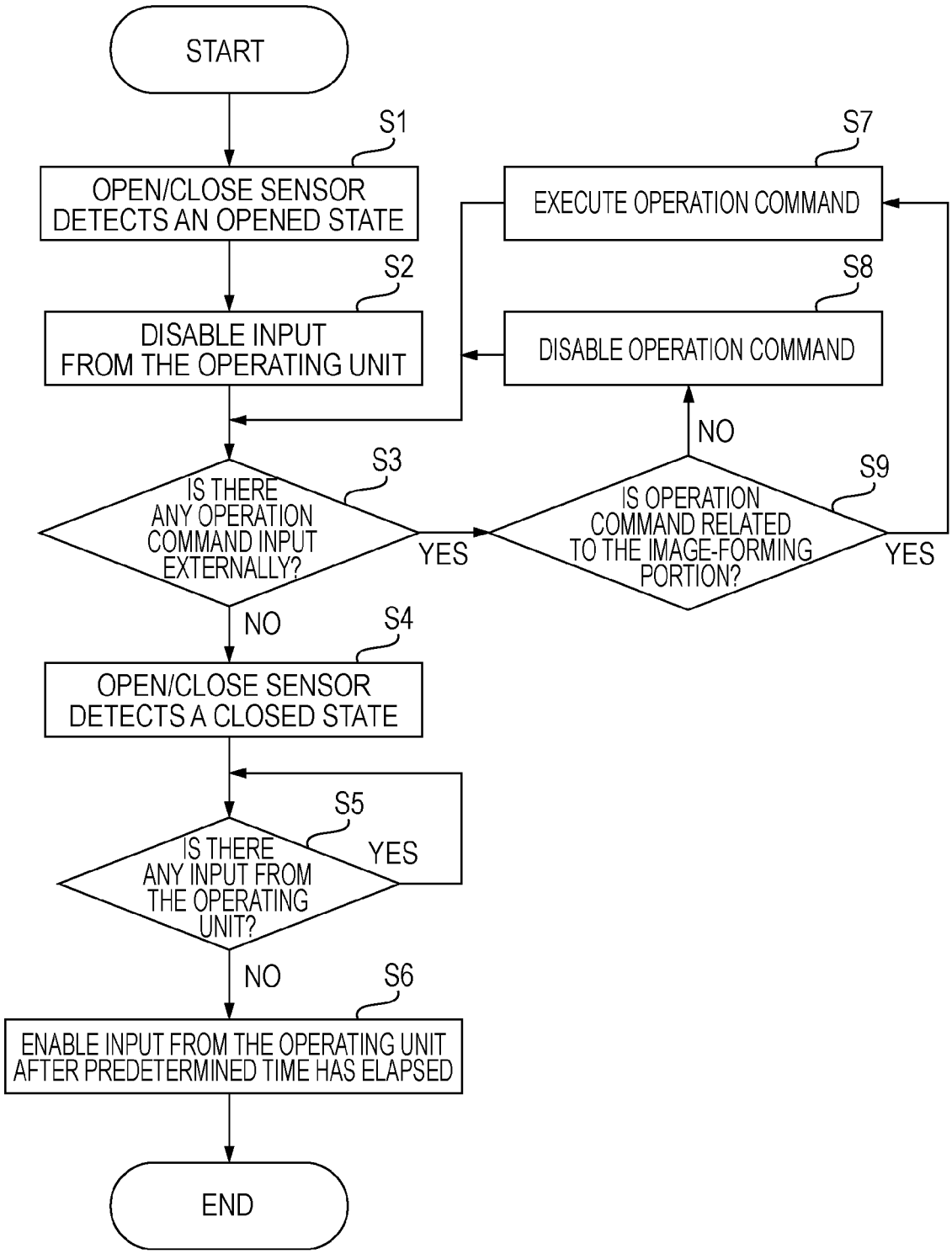
FIG. 3 is a control flowchart at the time of opening/closing the scanning unit.

Description will be made in detail regarding control according to opening/closing of the scanning unit U based on the flowchart in FIG. 3. The control unit C executes the control of the image-forming apparatus in accordance with the flowchart shown in FIG. 3 based on the program stored in the ROM.

Upon the operator opening the scanning unit U, the open/close sensor 71 detects whether or not the scanning unit U is in an opened state. In other words, the control unit C determines that the scanning unit U is in an opened state based on the signal from the open/close sensor 71 (step 1 (hereafter, "step" is abbreviated as "S")).

When determining that the scanning unit U is in an opened state, the control unit C ignores input by the operating unit 61 so as not to perform a setting/operation even in the event of the operator pressing an operating key (S2). In other words, the control unit C disables execution of the predetermined operation even if the instruction is performed by the operating unit 61, when the scanning unit U is in an opened state. Thus, the apparatus main unit is allowed to form an image on a sheet even when the scanning unit is in an opened state.

In a state in which the scanning unit U is opened, the operator is prevented from readily looking at the operating unit 61, so it can be conceived that pressing of an operating key is not an operation intended by the operator. Accordingly, disabling input from the operating unit 61 prevents a setting being changed against the operator's will, and the operation of the apparatus being started against the operator's will.

Further, when the scanning unit U is opened, i.e., while the open/close sensor 71 detects an opened state, the control unit C determines whether or not there is an operation command from the outside as to the image-forming apparatus (S3).

Now, in the event that there is an operation command as to the scanning portion, or the image-forming portion, or both, for example, via a USB terminal, or a phone line or LAN connected to the communication unit, as an operation command from the outside, the control unit C determines whether or not the operation command thereof is an operation command as to the image-forming portion (S9).

In the event of an operation command as to the image-forming portion, even in a state in which the scanning portion 52 is opened, there is no problem with the operation of the image-forming portion, and the control unit C performs control so as to execute the operation command thereof (S7). Even in the event that the scanning unit U is opened, the control unit C controls the image-forming portion so as to execute the operation of the image-forming portion.

In the event that the operation command thereof is not as to the image-forming portion but as to each unit within the scanning unit U, the control unit C disables the operation command thereof to prevent an abnormal operation in a state in which the scanning unit U is opened (S8). At this time, the control unit C informs the originating source of the operation command of the outside that the operation has not been performed since the scanning unit U is in an opened state.

Next, in the event that the scanning unit U is closed, the open/close sensor 71 detects that the scanning unit U is in a closed state. Specifically, the control unit C determines that the scanning unit U is in a closed state based on the signal from the open/close sensor 71 (S4).

When determining that the scanning unit U is in a closed state, the control unit C determines whether or not the operator is pressing an operating key at that time (S5).

In the event of the operator pressing an operating key, the flow returns to S5, where the control unit C repeats the same processing until the operator presses no operating key.

In the event of the operator pressing no operating key, the control unit C determines that there is no input of an operating key, and following predetermined time elapsing, enables input of an operating key (S6).

This is because an operation command against the operator's will is prevented from being executed in the event that the operator closed the scanning unit U while pressing an operating key of the operating key 61 when closing the scanning unit U.

Even if an operating key is being pressed by the operator, input of operating keys is disabled until the operator temporarily releases the key, whereby the image-forming apparatus 51 is prevented from operating.

Also, even in the event that the scanning unit U is opened, the control unit C controls the image-forming portion so as to execute the operation of the image-forming portion. With regard to this point, description has been made regarding a case wherein in a state in which the scanning unit U has been already opened, there is a new instruction for operating the image-forming portion. However, in the event that the image-forming portion is being operated before the scanning unit U is opened, and also even when the scanning unit U is opened during the operation of the image-forming portion, the control unit C controls the image-forming portion so as to continue the operation of the image-forming portion.

Also, the reason why input of an operating key is enabled following predetermined time elapsing, is that a case is assumed wherein once the operator has released an operating key, but unintentionally pressed an operating key again. The predetermined time mentioned here is such that the operator does not feel the time during which operations cannot be made is long, following the operator closing the scanning portion 52; specifically, one through three seconds.

Note that when the scanning unit U is opened, the maintenance cover 62 is opened to perform the maintenance of the image-forming mechanism such as exchange of the process cartridge, or jam processing at a sheet conveyance path within the apparatus main unit 60. According to an interlock switch shown in the drawing, detection is made that the maintenance cover 62 is in an opened state, and the operation command of the image-forming portion is immediately disabled regardless of the flowchart shown in FIG. 3. This prevents the image-forming portion from operating. Also, in the event that the image-forming portion is being operated, the control unit C stops the operation of the image-forming portion immediately following the maintenance cover 62 being opened.

With the present embodiment, as described above, following predetermined time elapsing after the signal from the open/close sensor 71 is switched from an opened signal to a closed signal, input of the operating unit 61 is enabled. Thus, even in the event that the operator unintentionally presses an operating key such as the hand of the operator being slipped immediately after the scanning unit U is closed, input of an operating key can be prevented from operating the apparatus.

In the event that input of the operating unit 61 is being performed when the signal from the open/close sensor 71 is switched from an opened signal to a closed signal, the control unit C enables input of the operating unit 61 following predetermined time elapsing after there is no input of the operating unit 61. Thus, even in the event of the operator closing the scanning unit U while pressing an operating key, or in the event of the operator unintentionally pressing an operating key immediately following releasing the operating key after closing the scanning unit U while pressing an operating key, the apparatus can be prevented from operating.

In the event that there is an operation command from other than the operating unit 61 when the open/close sensor 71 detects the opened state of the scanning unit U, the control unit C disables the operation command thereof when the operation command thereof is as to the scanning portion, but executes the operation command thereof when the operation command thereof is as to the image-forming portion. Thus, even when the scanning unit U is opened, there is no problem with to the operation of the image-forming portion, so the control unit C can execute the operation without causing an error. In the event of the operation command as to the scanning portion, operating the scanning portion when the scanning portion is opened means there is a high probability that an image on an original cannot be scanned, so the control unit C disables such an operation command, whereby malfunction at the time of scanning can be prevented.

Now, let us say that predetermined time from when detecting that the scanning unit U is closed until when input of the operating unit is enabled is first time T1. Also, in the event that input of the operating unit is being performed when detecting that the scanning unit U is closed, let us say that predetermined time from when detecting that there is no input of the operating unit following detecting that the scanning unit U is closed until when input of the operating unit is enabled is second time T2. With the above-mentioned embodiment, description has been made regarding an arrangement wherein the first time T1 and the second time T2 are the same time, but the first time T1 and the second time T2 may be set to different times.

Now, with the present embodiment, the scanning unit U keeps an opened state at an angle greater than 10 degrees by a function of the hinge 54. In other words, in the even that the angle when opening the scanning unit U is greater than 10 degrees, the scanning unit U rests while keeping the angle thereof. Also, the hinge 54 has a stopper function, which prevents the angle when the scanning unit U is opened from turning into 60 degrees or more. Thus, in the event that the angle when opening the scanning unit U is greater than 10 degrees, even if the operator releases the hand from the opened state, the scanning unit U does not fall, whereby an object can be prevented from being sandwiched by the scanning unit U which has fallen. With the present embodiment, the opened angle is arranged to be kept, but an arrangement may be made wherein in the event that the opened angle is greater than 10 degrees, the scanning unit U is opened from 45 degrees to 60 degrees automatically.

Also, in the event of the operator releasing his or her hand at an angle not greater than 10 degrees, the scanning portion 52 is arranged to be closed automatically by the weight thereof. In the event of an angle of 10 degrees or so, even if the scanning unit U is closed by the self-weight of the scanning unit U, impact thereof is small, but with the present embodiment, damper is embedded in the hinge 54, whereby the scanning unit U is closed slowly when the scanning unit U is closed automatically.

With the present embodiment, as described above, the hinge 54 serving as a supporting portion supports the scanning unit U so as to keep an opened state when the opened/closed angle of the scanning unit U as to the apparatus main unit is greater than a predetermined angle. Also, the hinge 54 supports the scanning unit U in a rotationally movable manner so as to cause the scanning unit U to close by the self-weight of the scanning unit U when the opened/closed angle is not more than a predetermined angle.

Also, the open/close sensor 71 is configured to detect that the scanning unit U is in an opened state when greater than 10 degrees, and detect that the scanning unit U is in a closed state when not more than 10 degrees in accordance with the above-mentioned specification of the hinge 54. Thus, the open/close sensor 71 does not detect a closed state when the scanning unit U is opened, whereby the opened/closed state of the scanning unit U can be detected accurately. However, it is necessary to cause the open/close sensor 71 to detect an opened state at an angle at least greater than 10 degrees, whereby detection of a closed state when the scanning unit U is opened can be avoided. Accordingly, for example, an opened state may be detected at an angle greater than 7 degrees.

Also, the reason why an arrangement has been made wherein the scanning unit U is automatically closed at an angle not more than 10 degrees is to clarify an opened state and a closed state of the scanning unit. If the detection angle is set to an angle smaller than 10 degrees, it becomes difficult to distinguish whether the scanning unit U is opened or closed by appearance thereof. On the other hand, if the detection angle is set to an angle greater than 10 degrees, a closed state is detected even when the scanning portion 52 is greatly inclined, and consequently, the scanning portion 52 is operated, which increases the probability that image failure, or jamming of an original at the original conveyance unit 59, will be caused.

Figure 8:
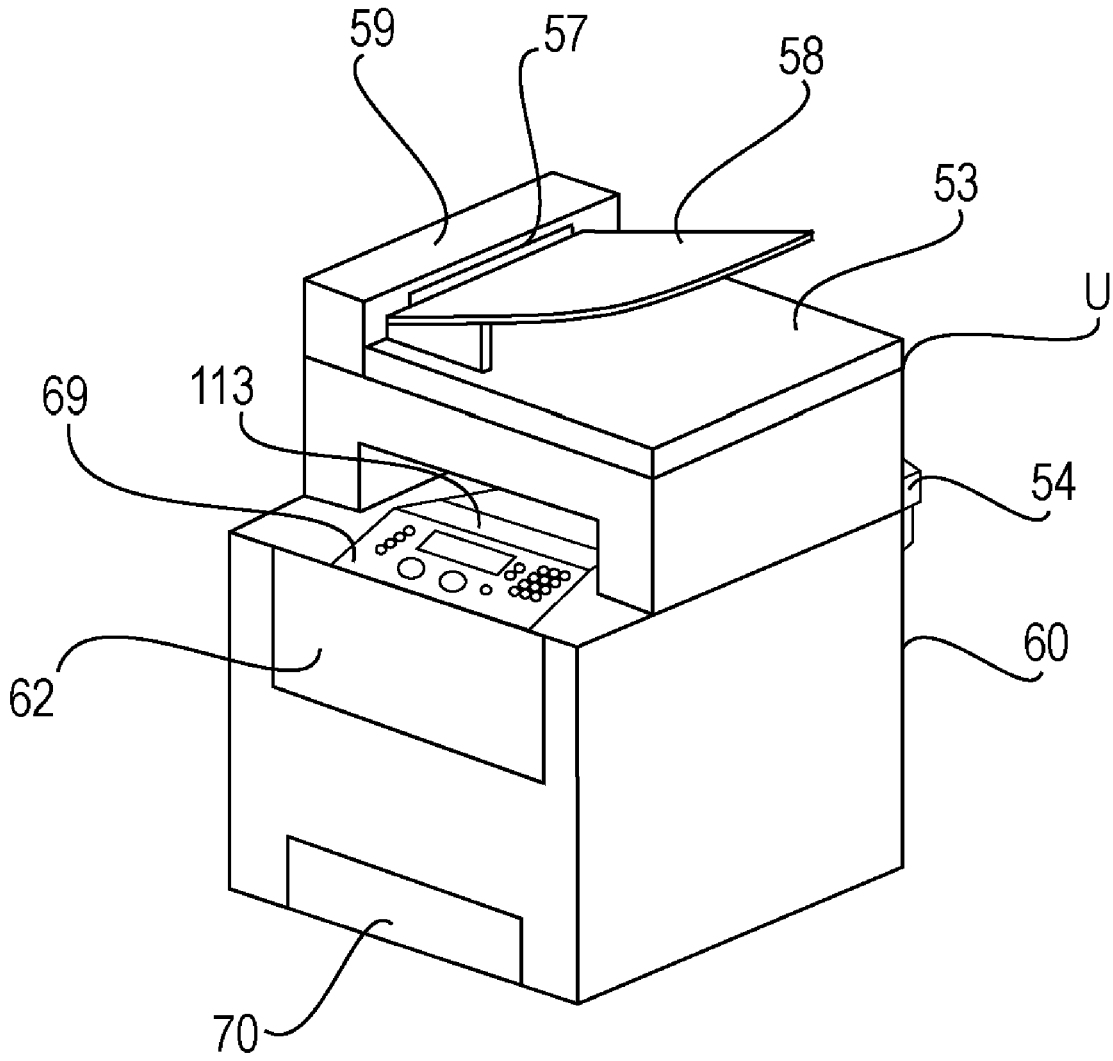
FIG. 8 is an explanatory diagram of an image-forming apparatus according to another embodiment of the present invention.

Another embodiment of the present invention is shown in FIG. 8. With the above-mentioned embodiment, the operating unit is provided in the scanning unit, but on the other hand, with another embodiment mentioned here, an operating unit 69 is provided in the apparatus main unit 60, which is the difference between both, and the other configurations are the same between both, so detailed description thereof will be omitted. Note that in FIG. 8, the same members as those in the above-mentioned embodiment are appended with the same reference numerals. The operating unit 69 is disposed in the near-to-operator side of the scanning unit U in the apparatus main unit 60 (the front side of the image-forming apparatus) at the center portion in the horizontal direction. This position of the operating unit 69 is also a position where the operator readily touches unintentionally when opening/closing the scanning unit U.

When determining that the scanning unit U is in an opened state based on the output from the open/close sensor, the control unit of the image-forming apparatus ignores input from the operating unit 69 such that a setting or operation is not executed even if the operator presses an operating key of the operating unit 69. Also, even when the scanning unit U is opened, the image-forming portion of the image-forming apparatus can perform an image-forming operation.

Note that with either of the above-mentioned embodiments, an arrangement has been shown wherein when the scanning unit U is in an opened state, input of all the keys of the operating unit is disabled as an example. However, for example, an arrangement may be made wherein input of only the start key 801 configured to allow the operator to start copying is disabled. The start key 801 is a key configured to allow the operator to start of the operation of the image-forming apparatus along with the operation of the scanning unit U. Accordingly, when the scanning unit U is in an opened state, disabling input by the start key 801 prevents the operation of the image-forming apparatus along with the operation of the scanning unit U from unintentional execution.

Note that with either of the above-mentioned embodiments, an arrangement has been shown wherein even when the operator presses each operating key, the control unit ignores pressing of the operating keys as an example. However, for example, an arrangement may be made wherein the operating unit is configured of a liquid crystal screen employing a touch panel method, and when the open/close sensor detects that the scanning unit is in an opened state, the control unit turns off the touch panel of the liquid crystal screen, and thus input by the operating unit is prevented, thereby disabling input by the operating unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-174140 filed Jun. 23, 2006, which is hereby incorporated by reference herein in its entirety.

What is claimed is:

1. An image-forming apparatus comprising:

an image forming unit configured to form an image on a recording medium;

a scanning unit, including a platen on which an original is placed and an image sensor, configured to open/close relative to the image forming unit and to scan an image of the original placed on the platen with the image sensor, wherein the image forming unit forms the image on the recording medium based on the image scanned by the scanning unit and an operation command from outside of the image-forming apparatus; and an instructing unit configured to perform an instruction for causing the image-forming apparatus to execute a scanning operation by the scanning unit, wherein the image-forming apparatus is disabled from executing the scanning operation regardless of whether the instruction is performed by the instructing unit when the scanning unit is in an opened state, and wherein the image forming unit forms an image on the recording medium based on the operation command from the outside of the image-forming apparatus regardless of whether the scanning unit is in an opened state.

2. An image-forming apparatus according to claim 1, wherein the scanning unit includes the instructing unit.

3. An image-forming apparatus according to claim 1, wherein the instructing unit is located near the scanning unit.

4. An image-forming apparatus according to claim 1, wherein a center of rotational movement for opening/closing the scanning unit is provided on one side of the scanning unit, and the instructing unit is provided on a side of the scanning unit opposite the one side.

5. An image-forming apparatus according to claim 1, wherein when a predetermined time period elapses after the scanning unit is closed, the image-forming apparatus can execute the scanning operation instruction by the instructing unit.

6. An image-forming apparatus according to claim 1, wherein if the instruction by the instructing unit is performed when the scanning unit is closed, the image-forming apparatus can execute the scanning operation by the instructing unit when a predetermined time period elapses after the instruction by the instructing unit.

7. An image-forming apparatus according to claim 1, further comprising:

a supporting unit rotatably supported to maintain an opening of the scanning unit when an opening angle of the scanning unit relative to the image forming unit is greater than a predetermined angle, and to close by a weight of the scanning unit when the opening angle is smaller than the predetermined angle; and a sensor configured to detect opening of the scanning unit, wherein the sensor detects that the scanning unit is in the opened state when the opening angle of the scanning unit is greater than the predetermined angle.

8. An image-forming apparatus according to claim 1, further comprising:

a discharge unit, provided on an upper surface of the image forming unit, where the recording medium upon which the image is formed is discharged, wherein the discharge unit is covered by the scanning unit in a closed state, and the discharge unit is exposed in an opened state.

* * * * *